US009422140B2

(12) United States Patent
Rottlaender et al.

(10) Patent No.: US 9,422,140 B2
(45) Date of Patent: Aug. 23, 2016

(54) ENDLESS CABLE WINCH WITH OVERLOAD PROTECTION

(71) Applicant: Tractel Greifzug GmbH, Bergisch Gladbach (DE)

(72) Inventors: Thomas Rottlaender, Overath (DE); Klaus-Dieter Ott, Kuerten (DE); Juergen Gsell, Remscheid (DE)

(73) Assignee: TRACTEL GREIFZUG GMBH, Bergisch Gladbach (DE)

( * ) Notice: Subject to any disclaimer, the term of this patent is extended or adjusted under 35 U.S.C. 154(b) by 278 days.

(21) Appl. No.: 14/146,384

(22) Filed: Jan. 2, 2014

(65) Prior Publication Data

US 2014/0110650 A1 Apr. 24, 2014

Related U.S. Application Data

(63) Continuation of application No. PCT/EP2012/062841, filed on Jul. 2, 2012.

(30) Foreign Application Priority Data

Jul. 4, 2011 (DE) ..... 10 2011 106 635

(51) Int. Cl.

| | |
|---|---|
| ***B66D 1/48*** | (2006.01) |
| ***B66D 1/54*** | (2006.01) |
| ***B66D 1/58*** | (2006.01) |
| ***B66D 1/74*** | (2006.01) |
| ***B66D 1/02*** | (2006.01) |

(52) U.S. Cl.

CPC . *B66D 1/54* (2013.01); *B66D 1/02* (2013.01); *B66D 1/58* (2013.01); *B66D 1/7415* (2013.01)

(58) Field of Classification Search

CPC ..... B66D 1/58; B66D 1/7415; B66D 3/10; B66D 5/16; B66D 5/18; B66D 2700/05

See application file for complete search history.

(56) References Cited

U.S. PATENT DOCUMENTS 3,912,093 A * 10/1975 Kruschke ..... B60P 1/5428 212/245
3,944,185 A 3/1976 Evans
5,090,666 A 2/1992 May (Continued)

FOREIGN PATENT DOCUMENTS

CH 541510 A 9/1973
DE 816731 B 10/1951

(Continued)

OTHER PUBLICATIONS

German Search Report from German Application No. 10 2011 106 635.0, dated Oct. 10, 2011, 5 pages.

(Continued)

*Primary Examiner* — Emmanuel M Marcelo
(74) *Attorney, Agent, or Firm* — Ohlandt, Greeley, Ruggiero & Perle, LLP

(57) ABSTRACT

An endless cable winch includes a working cable, a housing, in which is mounted a driving cable pulley around at least a part of which the working cable is wrapped, and further includes a drive for driving the driving cable pulley, wherein the housing is mounted so as to be pivotable about a pivot axis, and a sensor is provided for detecting a pivoting movement of the housing for detecting an overload state of the working cable.

20 Claims, 3 Drawing Sheets

(56) References Cited

U.S. PATENT DOCUMENTS

| | | | | | |
|---|---|---|---|---|---|
| 5,361,565 | A * | 11/1994 | Bayer | A63J 1/028 | 254/270 |
| 6,068,240 | A * | 5/2000 | Leveugle | B66D 1/58 | 254/277 |
| 7,311,297 | B1 * | 12/2007 | Bradshaw | B66D 3/18 | 254/271 |
| 7,624,967 | B1 * | 12/2009 | Doebler | B66D 1/50 | 212/348 |
| 2007/0272490 | A1 * | 11/2007 | Blasek | B66B 9/187 | 187/254 |
| 2010/0051767 | A1 * | 3/2010 | Erel | B66C 23/02 | 248/205.1 |
| 2014/0175252 | A1 * | 6/2014 | Hoffend, Jr. | A63J 1/02 | 248/550 |

FOREIGN PATENT DOCUMENTS

| | | | |
|---|---|---|---|
| DE | 955180 | B | 12/1956 |
| DE | 2326041 | A | 11/1973 |
| DE | 3819447 | A1 | 12/1989 |
| DE | 91109892 | | 1/1993 |
| DE | 10205434 | A1 | 8/2003 |
| DE | 19805568 | B4 | 2/2009 |
| EP | 0300892 | A1 | 1/1989 |
| EP | 0363800 | A1 | 4/1990 |
| EP | 0866023 | A2 | 9/1996 |
| GB | 256916 | A | 2/1927 |
| GB | 2110632 | A | 8/1979 |
| JP | H02138099 | A | 5/1990 |

OTHER PUBLICATIONS

International Search Report for PCT Application No. PCT/EP2012/062841, dated Sep. 24, 2012.

Written Opinion for PCT Application No. PCT/EP2012/062841, dated Sep. 24, 2012.

Japanese Office Action dated May 10, 2016 for corresponding Japanese Patent Application No. 2014-517759, with English translation, 9 pages.

* cited by examiner

ENDLESS CABLE WINCH WITH OVERLOAD PROTECTION

RELATED APPLICATIONS

This application is a continuation application of co-pending International Patent Application PCT/EP2012/062841 filed on Jul. 2, 2012 which claims priority of German patent application 10 2011 106 635.0 filed on Jul. 4, 2011 the contents of which is fully incorporated by reference herewith.

BACKGROUND OF THE INVENTION

The invention relates to an endless cable winch, comprising a working cable, a driving cable pulley around at least a part of which the working cable is wrapped, a drive for driving the driving cable pulley, and further comprising an overload detection device for identifying an overload of the working cable.

Endless cable winches of this type (also called "hoists") are widely used for transporting loads or people. Endless cable winches have, for safety reasons, an overload detection device which responds in the event of a certain passing of the rated load in order to shut off the endless cable winch and/or output a warning signal.

In the prior art, for an overload detection device, the load acting on the working cable is measured indirectly by means of a spring-loaded roller, by virtue of the travel of the roller being monitored.

The disadvantage of this principle is that the load acting on the working cable is influenced by the weight of the hanging-down strand of the working cable. As a result, the measurement result may deviate to a great extent in particular at relatively great heights, that is to say in the case of long hanging-down strands, and therefore an overload detection device based on this can be rather inaccurate.

SUMMARY OF THE INVENTION

It is a first aspect of the invention to disclose an endless cable winch which permits a reliable and highly precise overload detection.

It is a another aspect of the invention to disclose an endless cable winch which is of simple design.

It is a another aspect of the invention to disclose an endless cable winch that automatically shuts down the drive thereof in case of an overload detection.

It is another aspect of the invention to disclose an endless cable winch which allows for a relatively smooth braking of the endless cable winch in the event of failure of the working cable.

It is still another aspect of the invention to disclose an endless cable winch which is highly reliable.

It is still another aspect of the invention to disclose an endless cable winch which is of compact design.

These and other objects are achieved according to the invention, in the case of an endless cable winch of the type mentioned at the outset, in that the housing is mounted so as to be pivotable about a pivot axis, and in that a sensor for detecting a pivoting movement of the housing is provided.

The fact that, according to the invention, a pivoting movement of the housing is monitored by means of a sensor results in particularly simple and reliable load monitoring for the force exerted on the working cable, which load monitoring is not influenced by a hanging-down strand of the working cable.

In a further embodiment of the invention, the housing is pivotably mounted at a first end, and is suspended at a second end on an elongation element.

The elongation element may be a spring element, an elongation cable or the like.

Particularly simple and sensitive adaptation of a certain triggering force at which the sensor responds is permitted in this way.

In a further embodiment of the invention, the sensor is in the form of a travel sensor, elongation sensor, contact sensor, piezo sensor or magnetic sensor.

All of these sensor types permit adequately accurate and reliable detection of the force acting on the working cable.

In a further embodiment of the invention, the drive is shut off when the sensor responds.

In addition or alternatively, a warning signal may be output when the sensor responds.

In this way, a malfunction is as far as possible eliminated or at least limited in the event of an overload.

In a further embodiment of the invention, a safety cable is provided with a safety device which has a non-driven cable pulley, which is rotatably mounted in a housing and around at least a part of which the safety cable is wrapped, and also has an arresting device which is coupled via a brake to the cable pulley and which blocks, and brakes the safety cable by means of the brake, at a predetermined speed of the safety cable at least in one direction.

The arresting device hereby blocks, and brakes the safety cable by means of the brake, when the predetermined speed is reached. The result, during the catching of the safety cable by means of the safety device, is relatively gentle braking of the safety cable with a braking acceleration for example of the order of magnitude of approximately 2 g. This has the result that a low loading of the safety cable upon the response of the safety device is achieved. Also, the physical and psychological stress on the personnel located in the person lifting device which is moved by means of the endless cable winch is reduced in this way.

In a further embodiment of the invention, the arresting device comprises a ratchet wheel which interacts with a pawl mounted on the housing, in such a way that the pawl latches into the ratchet wheel at a predetermined speed of the safety cable.

In this way, an arresting device is provided which is highly robust and which is of simple and reliable design.

Here, in a preferred refinement of the invention, the pawl has a first pawl arm and a second pawl arm, between which the pawl is pivotably mounted on the housing, wherein the pawl is preloaded against the ratchet wheel in such a way that the first pawl arm can move along the ratchet wheel up to a predetermined speed, and latches with its second pawl arm into the ratchet wheel if the predetermined speed is exceeded in the downward direction of the safety cable.

In this way, it is possible to ensure reliable blocking of the ratchet wheel by means of the pawl. The predetermined speed at which the blocking takes place can be finely metered by means of the preload of the pawl.

In a further embodiment of the invention, the ratchet wheel and the cable pulley are rotatable about a common axis of rotation, and the ratchet wheel forms a friction brake with the cable pulley.

A simple and reliable construction is ensured in this way.

In a further embodiment of the invention, the brake is in the form of a conical brake.

The design of the brake as a conical brake yields a particularly effective braking action with a relatively small installation size.

It is furthermore preferable for the friction brake to comprise a first friction partner composed of a bronze alloy and a second friction partner composed of a steel alloy.

Here, the brake preferably has a cone angle of approximately 4° to 10°.

A particularly expedient configuration of the brake can be attained in this way.

It is also alternatively possible for a friction lining to be provided on at least one of the friction partners. It is then generally the case here that a larger cone angle is used, of approximately 10° to 40°, e.g. approximately 30°.

It has been found that such a design of a friction brake for the application according to the invention yields particularly expedient configuration parameters which permit in particular a high braking force.

In a further preferred embodiment of the invention, the ratchet wheel has an external cone which is spring-loaded against an internal cone of the cable pulley.

Here, the ratchet wheel may be preloaded against the internal cone of the cable pulley for example by means of a plate spring, the preload of which is preferably adjustable.

This measures yield a simple and reliable construction.

The use of a plate spring makes it possible to impart a very high pressing force, such that high braking forces can be transmitted.

In a further embodiment of the invention, at least the working cable or the safety cable are wrapped around the driving cable pulley or the cable pulley with a wrap angle of less than 300°, preferably of approximately 260° to 280°, particularly preferably of approximately 270°.

Whereas it is the case in conventional endless cable winches that the wrap angle is normally 360°, it has been recognized according to the invention that a smaller wrap angle may also be adequate. A smaller wrap angle of in particular approximately 270° has space advantages, since it is hereby possible in certain cases to dispense with a diverting roller.

The predetermined speed for the braking of the safety cable is preferably 20 to 40 meters/minute, preferably 25 to 35 meters/minute, preferably approximately 30 meters/minute.

In this way, adherence to the triggering speed predefined by the European standard EN 1808 can be ensured.

In a further embodiment of the invention, the driving cable pulley and the cable pulley are mounted in a common housing.

In this way, it is possible for both the winch and also the safety device to be of compact construction in a common housing.

It would however basically also be conceivable for the safety device to be formed as a separate unit with the arresting device and the brake.

In a further embodiment of the invention, the cable pulley has a biasing device for pressing the safety cable against the cable pulley.

In a further embodiment of the invention, the driving cable pulley has a biasing device for pressing the working cable against the driving cable pulley.

Here, the biasing device may be for example a spring-loaded pressing roller.

These measures concern additional safety measures which are basically not necessary, but which lead to a further increase in safety.

It is self-evident that the features of the invention mentioned above and the features of the invention yet to be explained below can be used not only in the respectively specified combination but rather also in other combinations or individually, without departing from the scope of the present invention.

BRIEF DESCRIPTION OF THE DRAWINGS

Further features and advantages of the invention will emerge from the following description of preferred exemplary embodiments with reference to the drawing, in which.

DETAILED DESCRIPTION OF PREFERRED EMBODIMENT

Figure 1:
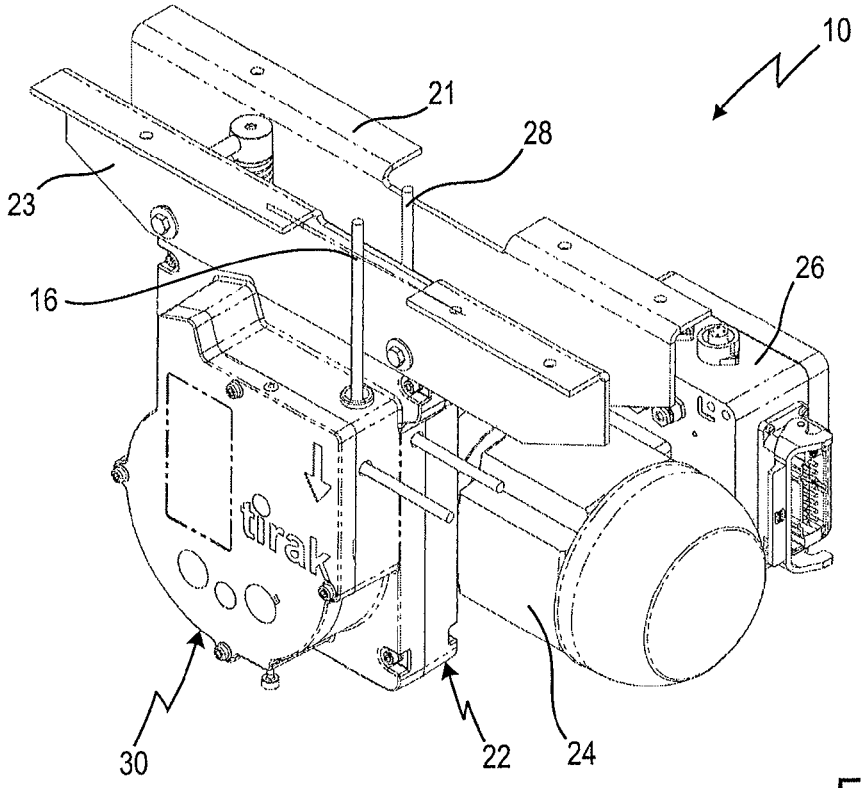
FIG. 1 shows a perspective illustration of an endless cable winch according to the invention.

FIG. 1 shows a perspective view of the endless cable winch 10. The endless cable winch 10 comprises a winch 22 which moves a working cable 28 upwards or downwards such that a load located thereon, e.g. lift cage, moves upwards or downwards on the working cable 28. The winch 22 comprises a drive 24 with a motor and a gearbox, and also comprises a controller 26.

In the situation illustrated here, in which people are conveyed, the endless cable winch 10 also comprises a safety device 30 through which a safety cable 16 is guided. If, by contrast, the endless cable winch 10 is used merely for transporting materials, it is possible to dispense with the safety cable 16 and the safety device 30. The winch 22 and the safety device 30 are accommodated in a common housing 54.

The endless cable winch 10 is designed for a certain rated load, for example 600 kg. To avoid overloading, or to avoid accidents in the event of overloading, the endless cable winch 10 has an overload detection device denoted as a whole by 11. The overload detection device 11 monitors the force acting on the working cable 28. If the rated load is exceeded, for example by 25%, the overload detection device 11 identifies an overload state. In this case, the drive is immediately stopped and a warning signal is output.

Figure 2:
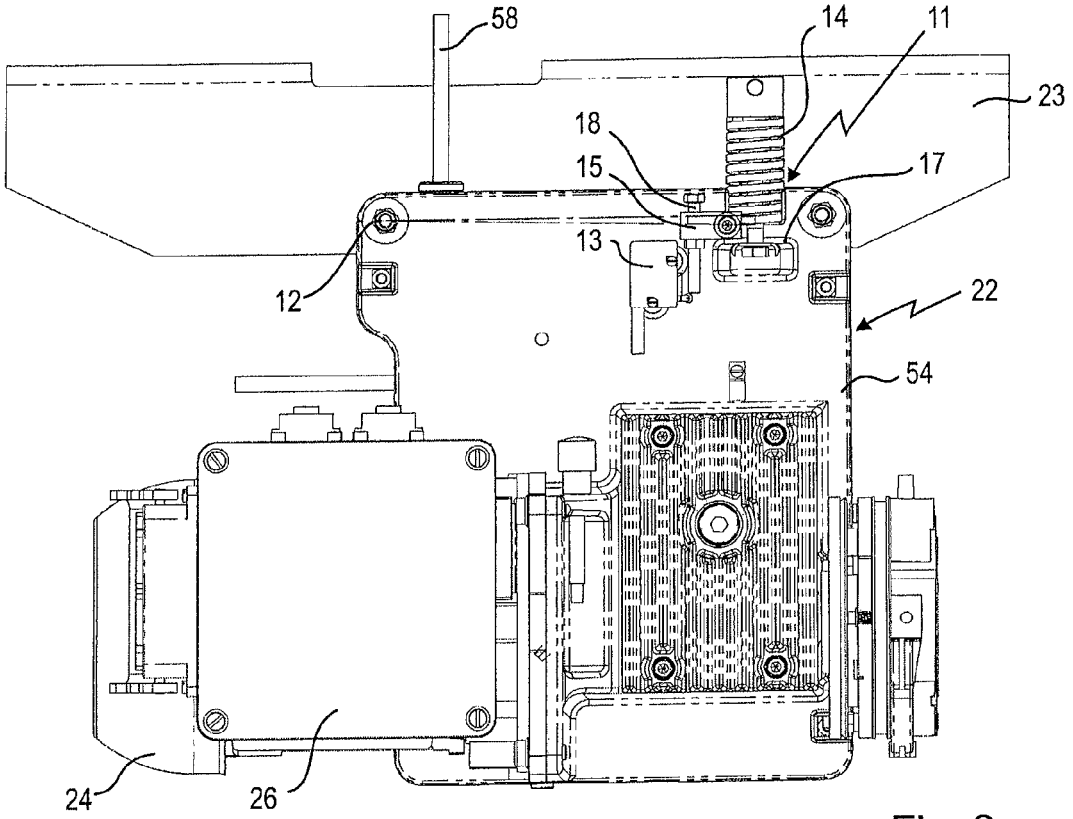
FIG. 2 shows a front view of the endless cable winch as per FIG. 1.
Figure 3:
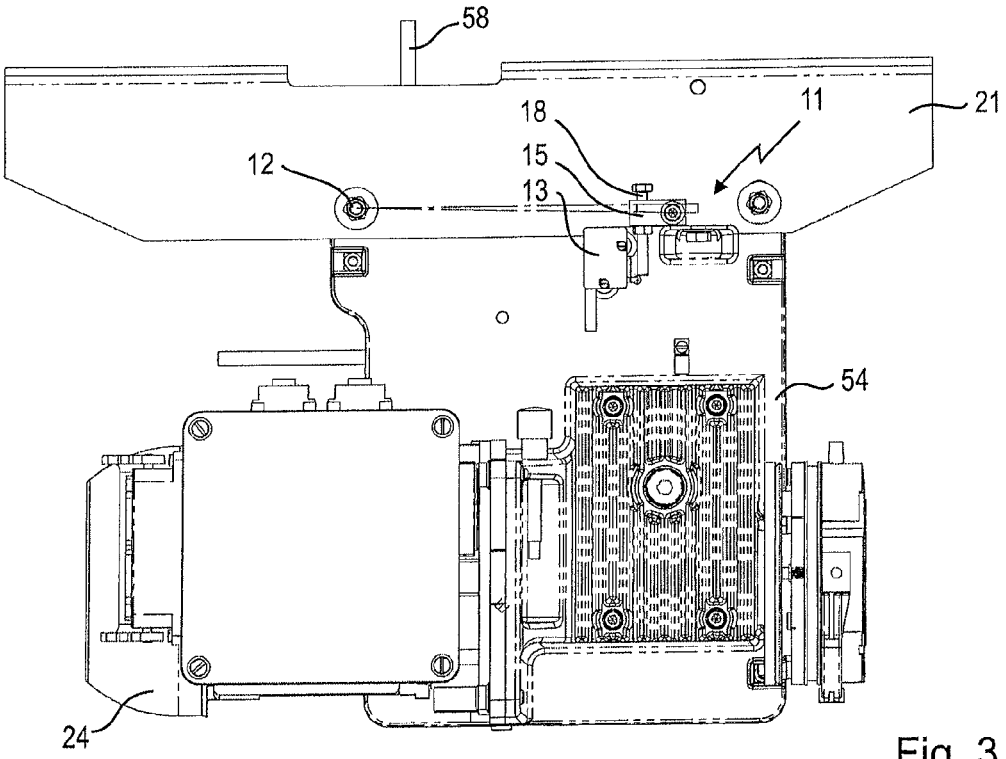
FIG. 3 shows a front view of the endless cable winch as per FIG. 2 but without the crossbeam on which the endless cable winch is accommodated.

FIGS. 2 and 3 show the endless cable winch 10 in a front view. The endless cable winch 10 is fastened to two beams 21, 23. Only the rear beam 23 is illustrated in FIG. 2, whereas FIG. 3 shows the front beam 21 which faces toward the viewer.

For the purpose of monitoring the load acting on the working cable 28, the housing 54 is held at a first end so as to be pivotable about a pivot axis 12. At the opposite, second end, the housing 54 is held on a spring 14 which is held with one end in a housing recess 17 and which is fastened with its other end to a beam on which the housing 54 is held. The spring acts on the housing 54 of the endless cable winch. A sensor 13 is fastened to the housing 54. A holder 15 comprises an adjusting screw 18 by means of which the value for the overload can be finely adjusted. The sensor 13 may for example be in the form of an electrical contact sensor which closes an electrical circuit when a contact-making end of the spring 14 makes contact. Various other embodiments of the sensor 13 are conceivable which respond when the housing 54 pivots about the pivot axis 12 by a certain pivot angle. This sensor could therefore for example also be a travel sensor in the form of a strain gauge or the like.

When the sensor 13 responds, the housing 54 has pivoted by a certain pivot angle as a result of the force acting on the working cable. The spring characteristic and the sensor are preferably coordinated with one another such that the sensor 13 responds when 125% of the rated load of the endless cable winch 10 is reached, that is to say at 750 kg in the case of a rated load of 600 kg. This corresponds to the EN1808 standard.

If the sensor 13 responds, the drive is automatically stopped and a warning signal, for example a visual warning signal and an acoustic warning signal, is output. Furthermore, the overload state may be transmitted electrically to further elements via a signal line. Since the overload generally occurs when the endless cable winch 10 is at a standstill, the drive cannot start in this case, and, as a result of the warning signal output, a user will generally immediately recognize the overload, such that he can correspondingly reduce the load.

Figure 4:
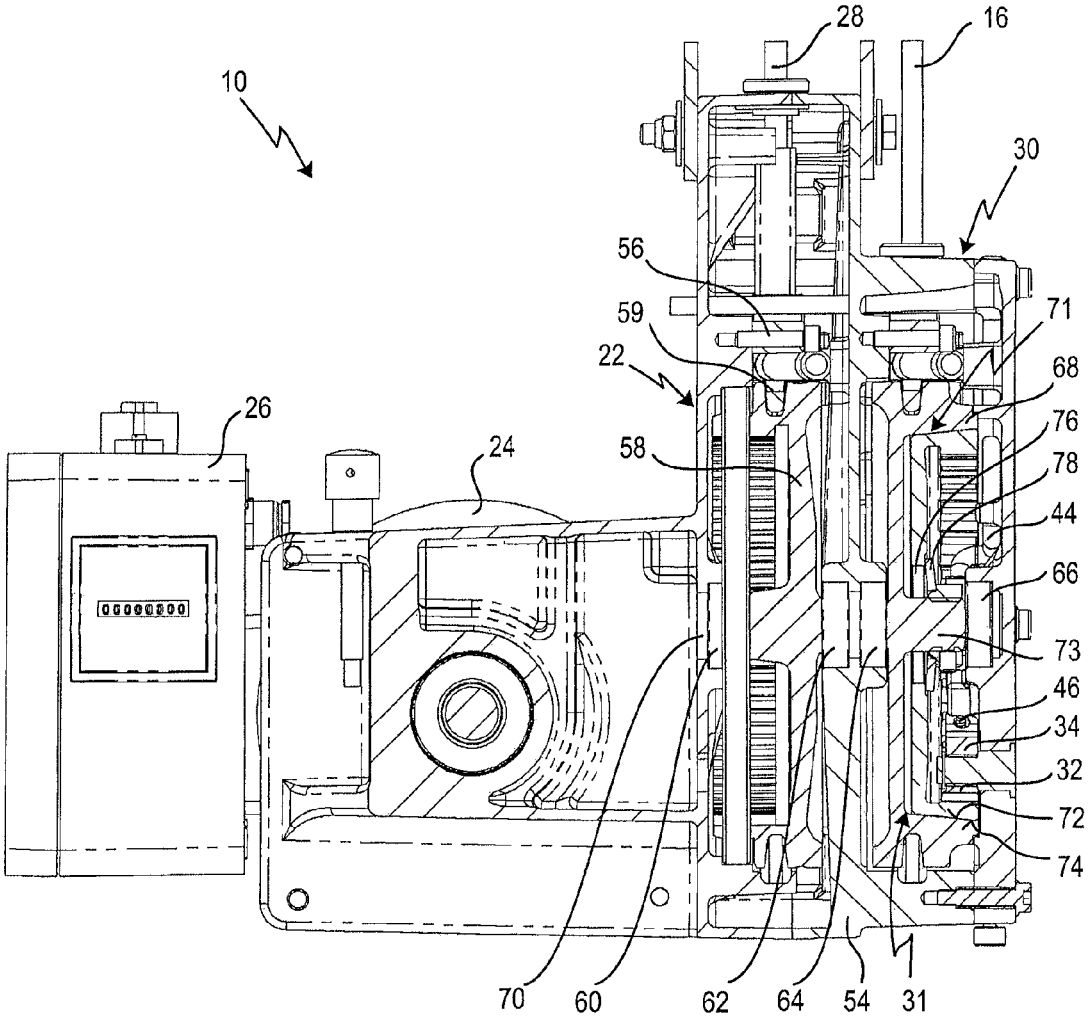
FIG. 4 shows a section through the endless cable winch as per FIG. 1.

The further construction of the winch 22 and of the safety device 30 can be seen from FIG. 4.

The winch 22 has a driving cable pulley 58 over which the working cable 28 is guided with a wrap angle of approximately 270°. The driving cable pulley 58 has a guide groove 59 in which the working cable 28 runs. A biasing device 56 is also provided for biasing or pressing the working cable 28 into the guide groove 59. This biasing device involves a pressing roller combined with a spring. The working cable 28 emerges laterally out of the winch 22, as can be seen from FIG. 1, after a wrap angle of approximately 270°, and can optionally then be diverted downwards by means of a diverting roller.

FIG. 4 also shows the drive 24 which comprises an electric motor and a gearbox. The output shaft 70 of the gearbox drives the driving cable pulley 58 via a shaft-type pinion (not illustrated).

As can also be seen from FIG. 4, both the driving cable pulley 58 and also the cable pulley 68 are each mounted in the common housing 54 of the winch 22 and of the safety device 30 by means of two bearings 60, 62, 64, 66.

The safety device 30 comprises an arresting device 31, the safety device being coupled by means of a brake, denoted as a whole by numeral 71, to a cable pulley 68 over which the safety cable 16 is guided. If the arresting device 31 arrests the safety cable 16 when a certain speed is reached, the cable pulley 68 is braked via the brake 71.

The arresting device 31 comprises a rotatably mounted ratchet wheel 32, which interacts with a pawl 34 which is pivotably mounted on the housing 54. The ratchet wheel 32 has an external cone 72 which bears against an internal cone 74 of the cable pulley 68. The ratchet wheel 32 is preloaded against the cable pulley 68 by means of a plate spring 78 which is supported against a bearing ring 76 on a journal 73 of the cable pulley, such that there is frictional engagement between the external cone 72 of the ratchet wheel 32 and the internal cone 74 of the cable pulley 68. The preload of the plate spring 78 can be adjusted by means of a nut 82 which is screwed onto a thread 80 on the journal 73. A biasing device 48, consisting of spring and pressing roller, is also provided for the cable pulley 68, for pressing the safety cable 16 into the guide groove provided therefor.

Figure 5:
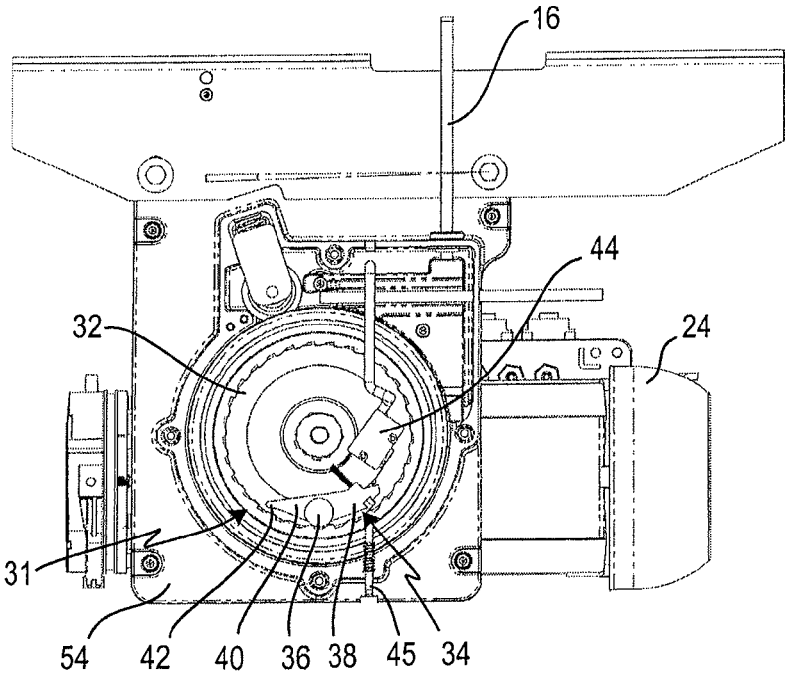
FIG. 5 shows a rear view of the endless cable winch as per FIG. 1, but after removal of the housing cover of the safety device.

FIG. 5 shows in more detail the construction of the arresting device 31 which is part of the safety device 30. The pawl 34 is held so as to be pivotable about a pivot axis 36. The pawl 34 has a first pawl arm 38 and a second pawl arm 40 which protrude in opposite directions from the pivot axis 36. The pawl 34 is preloaded by a spring 46, which is accommodated on a holder 44, in such a way that the first pawl arm 38 normally bears against the internal toothing of the ratchet wheel 32. In this position, the ratchet wheel can be moved both clockwise and also anticlockwise without the pawl leading to blocking against the ratchet wheel 32.

If the ratchet wheel 32 moves anticlockwise as per the illustration in FIG. 5, a load accommodated on the endless cable winch 10, for instance a lift cage, moves downwards. Here, the pawl 34 runs with its first pawl arm 38 on the toothed inner surface of the ratchet wheel 32. The stress of the spring 46 is now set such that, when the downward speed of the safety cable 16 reaches approximately 30 meters per minute, the interaction of the first pawl arm 38 with the toothed inner surface of the ratchet wheel 32 causes the pawl 34 to lift from the inner surface of the ratchet wheel 32 and turn over, such that the pawl latches with a latching lug 42 at the end of the second pawl arm into the inner surface of the ratchet wheel 32, and the ratchet wheel 32 is thus blocked by means of the pawl 34 mounted in the housing 54. The arresting device 31 is thus arrested and causes the rotatably mounted ratchet wheel 32 to be fixed at the pawl 34. A response of the arresting device 31 is signalled by the switch 44.

The function of the safety device 30 is as follows:

In the normal situation, the non-driven cable pulley 68 runs synchronously with the driving cable pulley 58. The safety cable 16 thus moves at the same speed as the working cable 28 over the cable pulley 68.

If, for any reason, the winch 22 fails, either as a result of breakage of the working cable 28 or gearbox failure in the drive 24, which would cause the load accommodated on the endless cable winch 10 to fall downwards, the load moves downwards initially at an increased speed until the triggering speed of the arresting device 31 is reached. At approximately 30 meters per minute, the pawl 34 blocks against the ratchet wheel 32, such that the previously rotating cable pulley 68 is now braked by means of the conical brake 71 until the safety cable 16 finally comes to a standstill.

By means of a button 45, the pawl 34 can also be moved into its arresting position manually, mechanically, electrically or in some other way. For this purpose, the button 45 is actuated once in order to pivot the pawl 34. The arresting position is automatically eliminated again if the safety cable 16 is moved in the upward direction again.

What is claimed is:

1. An endless cable winch, comprising:

a housing having a first end and a second end, said housing being mounted pivotably about a pivot axis at said first end and being suspended from an elongation element at said second end;

a driving cable pulley mounted within said housing;

a working cable being wrapped at least partially around said driving cable pulley;

a drive for driving said driving cable pulley;

an overload detection device for detecting an overload of said working cable, said overload detection device comprising a sensor for detecting when a pivoting movement of said housing exceeds a certain pivot angle, thereby indicating an overload of said working cable.

2. The endless cable winch of claim 1, wherein said elongation element is configured as a spring element.

3. The endless cable winch of claim 1, wherein said sensor is configured as sensor selected from the group consisting of a travel sensor, an elongation sensor, a contact sensor, a piezo sensor, a magnetic sensor, and a movement sensor.

4. The endless cable winch of claim 1, wherein said sensor is configured for outputting a signal indicating an overload state when said sensor responds.

5. The endless cable winch of claim 4, wherein said drive is configured for being shut off upon receiving said signal from said sensor indicating an overload.

6. The endless cable winch of claim 1, wherein said working cable is wrapped around said driving cable pulley with a wrap angle of less than 300°.

7. An endless cable winch, comprising:

a housing being mounted pivotably about a pivot axis;

a driving cable pulley mounted within said housing;

a working cable being wrapped at least partially around said driving cable pulley;

a drive for driving said driving cable pulley;

an overload detection device for detecting an overload of said working cable, said overload detection device comprising a sensor for detecting when a pivoting movement of said housing exceeds a certain pivot angle, thereby indicating an overload of said working cable;

a non-driven safety cable pulley being mounted rotatably;

a safety cable extending through said cable winch, at least partially being wrapped around said safety cable pulley;

a brake being coupled to said safety cable pulley; and an arresting device being coupled to said brake and being configured for activating said brake for blocking and friction braking said safety cable when said safety cable reaches a threshold speed at least in one direction.

8. The endless cable winch of claim 7, wherein said brake is configured as a friction brake.

9. The endless cable winch of claim 8, wherein said arresting device comprises a ratchet wheel mounted rotatably within said housing, and a pawl mounted on said housing cooperating with said ratchet wheel, for latching into said ratchet wheel when said safety cable reaches said threshold speed of said safety cable.

10. The endless cable winch of claim 9, wherein said pawl comprises a first pawl arm and a second pawl arm, between which said pawl is pivotably mounted on said housing, wherein said pawl is preloaded against said ratchet wheel in such a way that said first pawl arm can move along said ratchet wheel up to said threshold speed, and latches with its second pawl arm into said ratchet wheel if said threshold speed is exceeded in a downward direction of said safety cable.

11. The endless cable winch of claim 10, further comprising a sensor for detecting a blocking of said arresting device, said sensor being configured for outputting a signal indicating said blocking.

12. The endless cable winch of claim 7, wherein said brake is configured as a conical brake.

13. The endless cable winch of claim 9, wherein said ratchet wheel comprises an external cone which is spring-loaded against an internal cone arranged on said safety cable pulley.

14. The endless cable winch of claim 13, wherein said ratchet wheel and said safety cable pulley are rotatable about a common axis of rotation, and wherein said ratchet wheel forms said friction brake with said safety cable pulley.

15. The endless cable winch of claim 7, wherein said driving cable pulley and said safety cable pulley are mounted in a common housing.

16. An endless cable winch, comprising:

a housing being mounted pivotably about a pivot axis;

a driving cable pulley mounted within said housing;

a working cable being wrapped at least partially around said driving cable pulley;

a drive for driving said driving cable pulley;

an overload detection device for detecting an overload of said working cable, said overload detection device comprising a sensor for detecting when a pivoting movement of said housing exceeds a certain pivot angle, thereby indicating an overload of said working cable.

17. The endless cable winch of claim 16, wherein said sensor is configured as sensor selected from the group consisting of a travel sensor, an elongation sensor, a contact sensor, a piezo sensor, a magnetic sensor, and a movement sensor.

18. The endless cable winch of claim 16, wherein said sensor is configured for outputting a signal indicating an overload state when said sensor responds.

19. The endless cable winch of claim 18, wherein said drive is configured for being shut off upon receiving said signal from said sensor indicating an overload.

20. The endless cable winch of claim 16, wherein said working cable is wrapped around said driving cable pulley with a wrap angle of less than 300°.

* * * * *